US010870116B2

(12) United States Patent
Möschl

(10) Patent No.: US 10,870,116 B2
(45) Date of Patent: Dec. 22, 2020

(54) AGITATOR BALL MILL WITH CERAMIC LINING

(71) Applicant: NETZSCH-Feinmahltechnik GmbH, Selb (DE)

(72) Inventor: Holger Möschl, Selb (DE)

(73) Assignee: NETZSCH-Feinmahltechnik GmbH, Selb (DE)

( * ) Notice: Subject to any disclaimer, the term of this patent is extended or adjusted under 35 U.S.C. 154(b) by 261 days.

(21) Appl. No.: 15/887,548

(22) Filed: Feb. 2, 2018

(65) Prior Publication Data

US 2018/0221888 A1 Aug. 9, 2018

(30) Foreign Application Priority Data

Feb. 3, 2017 (EP) ..... 17000174

(51) Int. Cl.
*B02C 17/16* (2006.01)
*B02C 17/22* (2006.01)
*B02C 17/18* (2006.01)

(52) U.S. Cl.
CPC ..... *B02C 17/16* (2013.01); *B02C 17/166* (2013.01); *B02C 17/18* (2013.01); *B02C 17/22* (2013.01)

(58) Field of Classification Search
CPC ..... B02C 17/16; B02C 17/18; B02C 17/22; B02C 17/166; B02C 17/1815; B02C 17/1825
USPC ..... 241/170, 182, 183
See application file for complete search history.

(56) References Cited

U.S. PATENT DOCUMENTS

| | | | | |
|---|---|---|---|---|
| 4,915,307 | A * | 4/1990 | Klimaschka | B02C 17/16 241/172 |
| 5,379,952 | A * | 1/1995 | Geiger | B02C 17/16 241/172 |
| 7,571,871 | B2 * | 8/2009 | Muzzio | G01N 3/24 241/172 |
| 2019/0358638 | A1 * | 11/2019 | Belke | B02C 17/22 |

FOREIGN PATENT DOCUMENTS

| | | | |
|---|---|---|---|
| CH | 682465 | A5 | 9/1993 |
| DE | 3723558 | A1 | 1/1989 |
| DE | 4401384 | A1 | 9/1994 |
| EP | 0299529 | A2 | 1/1989 |
| JP | S6393358 | A | 4/1988 |
| JP | 2014155913 | A | 8/2014 |

OTHER PUBLICATIONS

Myers, Analytical Methods in Conduction Heat Transfer, 1998, AMCHT Publications, Second Edition, p. 2 (Year: 1998).*

* cited by examiner

*Primary Examiner* — Shelley M Self
*Assistant Examiner* — Teresa A Guthrie
(74) *Attorney, Agent, or Firm* — Whitmyer IP Group LLC

(57) ABSTRACT

The invention relates to an agitator ball mill, with a grinding container, the inner side of which is made of a ceramic material, a rotor arranged inside the grinding container with a grinding gap formed between the surface of rotor and the inner side of the grinding container, a plurality of cams, fitted to the inner side of the grinding container and extend radially inwards. Wherein the ratio of the height of each cam and the inner diameter of the grinding container is ≤0.05, and wherein the ratio of the height of each cam and the grinding gap width is ≤0.35.

19 Claims, 9 Drawing Sheets

AGITATOR BALL MILL WITH CERAMIC LINING

TECHNICAL FIELD

The invention relates to agitator mills, in particular agitator mills with a grinding container, the inner side whereof is made of a ceramic material. Such an agitator mill is known from DE 37 23 558 A1.

BACKGROUND

Agitator mills, often also referred to agitator ball mills, are frequently used nowadays in manufacturing industry in order to reduce the size of materials to a fine state and in particular to produce powder. The functional principle of an agitator mill is based on the fact that an annular grinding gap is constituted between the inner side of a grinding container and a rotor arranged in the grinding container, in which grinding gap the material to be size-reduced is located during the operation of the agitator mill. By means of the rotary driving of the rotor, the material to be size-reduced is subjected to loading in the grinding gap which is such that it is size-reduced, for example by particles colliding with one another, by shearing forces etc. To reinforce the size-reduction effect, protrusions such as cams, rods or suchlike are often arranged at the inner side of the grinding container and/or on the outer circumference of the rotor, which on the one hand promote thorough mixing of the material to be size-reduced and on the other hand for example drastically increase the number of collision processes taking place in the grinding gap, which enhances the size-reduction effect of an agitator mill. As a rule, the grinding gap of an agitator mill is filled for the most part with auxiliary grinding bodies, which are usually spherical and are therefore referred to as grinding balls. In such agitator ball mills, the material to be sized-reduced is in particular also size-reduced by the effect of the auxiliary grinding bodies moving during the operation. The grinding container and the rotor arranged in the latter for the rotation often have a cylindrical shape, although other shapes are possible and known, e.g. truncated cone-shaped rotors and grinding containers constituted so as to be adapted thereto.

Depending on the size-reduction task to be accomplished, the grinding container of an agitator mill must be made on the inside from a material that is as abrasion-resistant as possible and is also inert, and which in addition also often has to be very heat-resistant. For this purpose, it is known to provide the grinding container with a ceramic grinding chamber lining (see the initially cited DE 37 23 558 A1). Especially when an agitator ball mill has a fairly large grinding volume or when a high power input is desired, the problem of sufficient cooling of the material to be sized-reduced exists during the grinding process. In addition, there is the risk that the auxiliary grinding bodies do not mix sufficiently with the product to be sized-reduced and therefore an inadequate grinding result is obtained.

SUMMARY

The problem underlying the present invention is to provide an agitator mill which permits a high power input during grinding, without the material to be size-reduced being exposed to excessive temperatures, and which moreover achieves reproducibly good and uniform grinding results.

According to the invention, this problem is solved, proceeding from the generic prior art mentioned at the outset, by the fact that the inner side of the grinding container is formed by a one-piece container tube made of ceramic material, that a ratio of the height of each cam normal to the inner side of the grinding container and the inner diameter of the grinding container is 0.05, and that a ratio of the height of each cam normal to the inner side of the grinding container and the grinding gap width is 0.35. The effect of the described features is that, in an agitator mill according to the invention, the cams or protrusions have a large base area compared to their height both in respect of the total inner diameter of the grinding container and also in respect of the grinding gap width, as a result of which better cooling of the material to be size-reduced can on the one hand thus take place, because the large base area more effectively dissipates heat into the grinding container, and on the other hand a sensitivity of the cams or projections to break off or break out, which exists particularly with ceramic material, is markedly reduced. The one-piece embodiment of the container tube promotes both the stability as well as the heat dissipation, since potential breakage points and heat conduction barriers are removed.

According to a preferred embodiment, the one-piece container tube made of ceramic material is not in contact on its outer peripheral side with a casing made for example of steel, but rather is installed with a radial spacing from other protecting and supporting components of the agitator mill. Stresses caused by different temperature expansion coefficients are thus prevented, which could have an adverse effect on the one-piece container tube made of ceramic material. Furthermore, the heat dissipation to the exterior is further improved.

Both the container tube and also the cams are preferably made of silicon carbide, SiC, or of silicon carbide with free silicon, SiSiC. These two ceramic materials have a high resistance to wear, low sensitivity to thermal shock, low thermal expansion, high thermal conductivity, good resistance to acids and lyes and moreover are lightweight and retain their favourable properties up to temperatures well above 1000° C.

Apart from the previously stated ratios, it has also proved to be advantageous if each cam has a connecting surface area to the inner side of the grinding container with a maximum width and the ratio of the height of each cam normal to the inner side of the grinding container and the maximum width is greater than 0.2. The connecting surface area just mentioned corresponds to the base area of each cam described above and means the area with which each cam is in contact with the inner side of the grinding container.

Furthermore, it has proved to be advantageous if each cam has a connecting surface area to the inner side of the grinding container with a maximum length and the ratio of the height of each cam and the maximum length is less than 1.

It is also advantageous if each cam has a connecting surface area to the inner side of the grinding container with a maximum length and a maximum width, wherein the ratio of the maximum width and the maximum length is less than 1.

The aforementioned advantageous embodiments can be used by themselves or can be combined with one another and in each case enhance the advantageous effects mentioned above.

For good stability of the cams and to achieve a uniformly good grinding result, it is advantageous if each cam has a connecting surface area to the inner side of the grinding container and a frontal incident-flow surface area, wherein a ratio of a projection of the frontal incident-flow surface area onto a plane lying normal to the inner side of the grinding container and the size of the connecting surface area is less than 1. An angle of inclination of the frontal incident-flow surface area relative to the plane lying normal to the inner side of the grinding container can lie in a range from −45° to 85°. An angle of 0° corresponds to an incident-flow surface area arranged normal to the inner side of the grinding container, whereas angles with a negative sign denote undercut incident-flow surface areas, i.e. incident-flow surface areas which are inclined such that they roof over as it were a certain region of the inner side of the grinding container. Angles of inclination with a positive sign accordingly denote frontal incident-flow surface areas which are inclined the other way round, i.e. with which the end of the incident-flow surface area located at the inner side of the grinding container receives the incident flow first.

Basically, it is advantageous to provide a plurality of cams at the inner side of the grinding container in order to promote the desired interaction with the material to be size-reduced. The grinding container can also comprise cam-free regions at its inner side, or can have more cams in some regions and fewer cams in other regions. In addition, not all cams need to be the same, but can be arranged in different shapes and sizes in different regions.

In the sense of the problem to be solved, it may be advantageous for a plurality of cams to be arranged successively in a row along a peripheral line in the peripheral direction of the inner side of the grinding container and for a spacing between successive cams in the peripheral direction to be equal to or greater than the maximum length of a cam.

If a multiplicity of cams are each arranged successively in a row along a plurality of peripheral lines spaced apart from one another in the axial direction, an axial spacing between each two axially adjacent cam rows is advantageously greater than or equal to 1.1 times the maximum width of a cam. If cams are present at the inner side of the grinding container spaced apart from one another in the axial direction, these cams can then be arranged either axially aligned or also offset with respect to one another.

Finally, it may be advantageous to arrange some or all the cams, viewed in plan view, at an angle to the respective peripheral line, wherein this angle preferably lies in a range from −22.5° to 22.5°, relative to the respective peripheral line arranged at an angle of 0°.

For the further enhancement of the desired interactions for the size reduction, the rotor can also be provided, in a known manner, with protrusions projecting radially outwards for example in the form of agitator rods. These protrusions and the surface of the rotor can also be made of ceramic material, in particular of silicon carbide or of silicon carbide with free silicon. The protrusions or agitator rods on the rotor can enter or not into the gaps present axially between cams or cam rows. In the first case, one speaks of the fact that the agitator rods overlap with the cams, i.e. an outer circular diameter of the agitator rods is greater than an inner circular diameter of the cams. One speaks of non-overlapping agitator rods or protrusions, on the other hand, when that the agitator rods are too short to enter into the axial intermediate spaces between cams or cam rows.

If protrusions are provided at the inner side of the grinding container and moreover protrusions are provided on the outer peripheral surface of the rotor, these protrusions (cams) at the inner side of the grinding container are advantageously smaller than the protrusions (agitator rods) on the rotor or the agitator shaft. In the context of the present description, protrusions present at the inner side of the grinding container are referred to as cams and protrusions present on the rotor or agitator shaft are referred to as agitator rods to permit an easier distinction to be made between the two. A different meaning of the terms should not however be associated with these designations selected for the purpose of making an easier distinction, i.e. both the cams and the agitator rods are protrusions, the shape whereof is not to be restricted by the selected designation. Both the protrusions at the inner side of the grinding container and also the protrusions on the rotor or the agitator shaft can have any shape, size and arrangement considered to be suitable for achieving a desired grinding result.

BRIEF DESCRIPTION OF THE DRAWINGS

For a better understanding of the invention, preferred embodiments of an agitator mill according to the invention are explained below in greater detail with the aid of the appended diagrammatic figures. In the figures.

DETAILED DESCRIPTION

Figure 1:
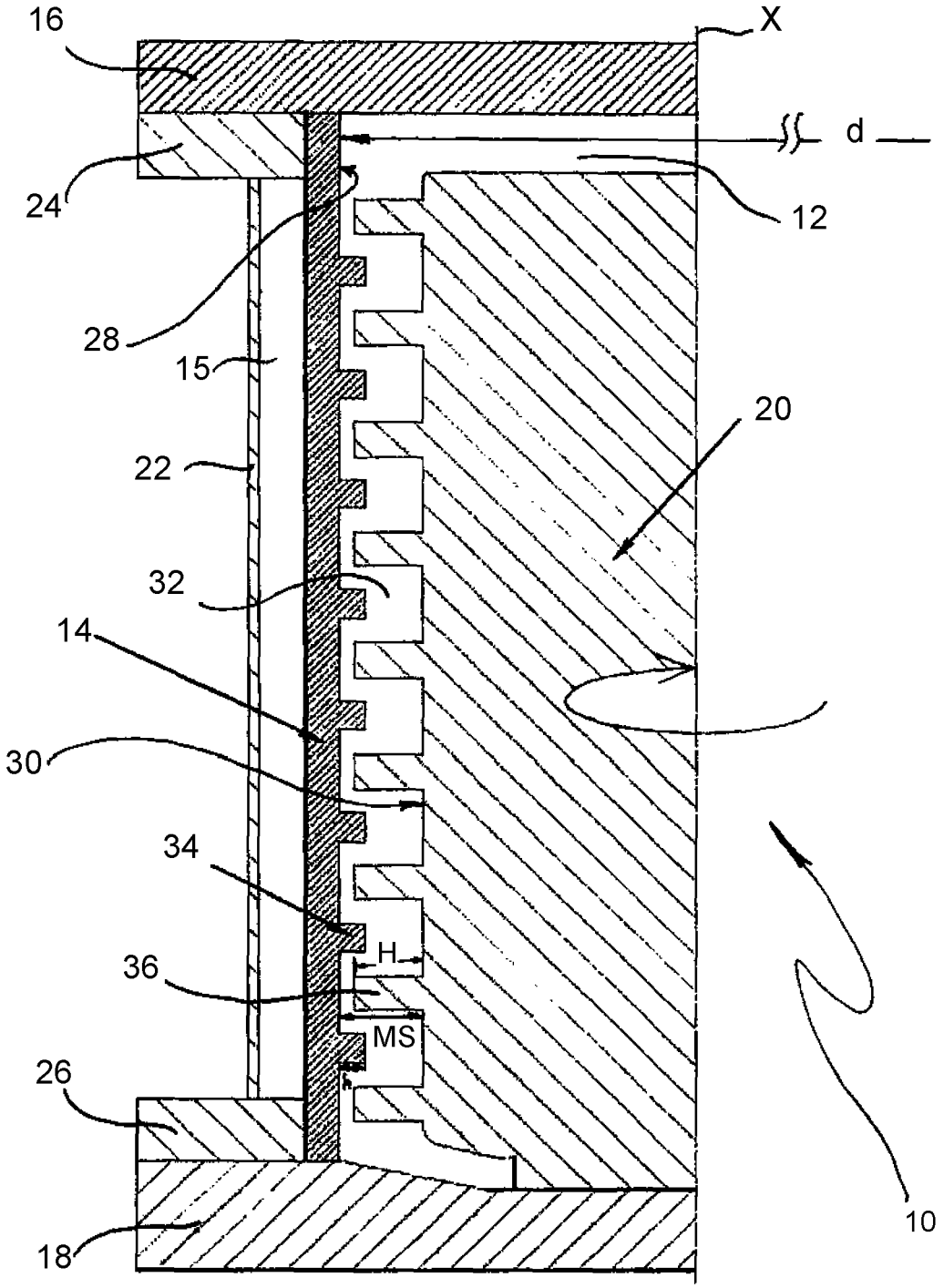
FIG. 1 shows a diagrammatic representation of an agitator mill according to the invention in an axial cross-section.

FIG. 1 shows an agitator mill denoted overall by 10 with a grinding container 12 which is cylindrical here, the peripheral boundary whereof is formed by a one-piece container tube 14 of ceramic material, the central longitudinal axis X whereof is also the axis along which grinding container 12 extends. Container tube 14 and therefore grinding container 12 has an inner diameter d and is accommodated, in a manner not shown in detail, between two end-face flanges 16, 18, which axially limit grinding container 12.

A rotor 20 mounted rotatably about axis X is arranged in grinding container 12, which rotor is often also referred to as an agitator shaft. Rotor 20 can be caused to rotate by a drive (not shown here) of agitator mill 10 and, in the example of embodiment represented, extends over virtually the entire length of grinding container 12, but in other embodiments can also be much shorter than the grinding container. For the sake of simplicity, only one half of agitator mill 10 is representative of FIG. 1, but it goes without saying that the other half, not represented in FIG. 1, has a mirror-image appearance with respect to the X axis.

For the protection of container tube 14 made of ceramic material, which reacts sensitively to impacts, a casing 22 in the form of a thin-walled cylindrical steel tube is provided with a radial spacing from container tube 14 at the outer peripheral side thereof, said casing being carried by two end-face, annular flanges 24, 26, which for their part are supported axially on flanges 16, 18 as represented. If desired or necessary, a cooling or heating liquid can flow through annular space 15 present between casing 22 and container tube 14.

A grinding gap 32 with a grinding gap width MS is formed between an inner side 28 of the grinding container formed by container tube 14 and a surface 30 of rotor 20 facing towards this inner side of the grinding container. Grinding gap 32 extends between the aforementioned surfaces in a circular manner about axis X and, during operation of agitator mill 10, is filled at least nearly completely with material to be sized-reduced and, as the case may be, with auxiliary grinding bodies (not represented), so that grinding of the material to be sized-reduced takes place in grinding gap 32 when rotor 20 rotates.

To intensify the grinding process in grinding gap 32, a plurality of protrusions projecting radially inwards are provided at inner side 28 of the grinding container, which protrusions are referred to here as cams 34 and extend with a height h normal to inner side 28 of the grinding container radially inwards into grinding gap 32 or into grinding container 12. These cams 34 can be constituted in one-piece with container tube 14 or can subsequently be fastened in a suitable manner to inner side 28 of the grinding container. Furthermore, rotor 20 is also provided with protrusions projecting radially outwards from its peripheral surface 30, which protrusions are referred to in the example of embodiment shown as agitator rods 36 on account of their rod-like shape. These agitator rods 36 have a height H measured normal to surface 30 and, like cams 34, can either be constituted in one-piece with rotor 20 or can subsequently be fastened to rotor 20 in a suitable manner.

Figure 2:
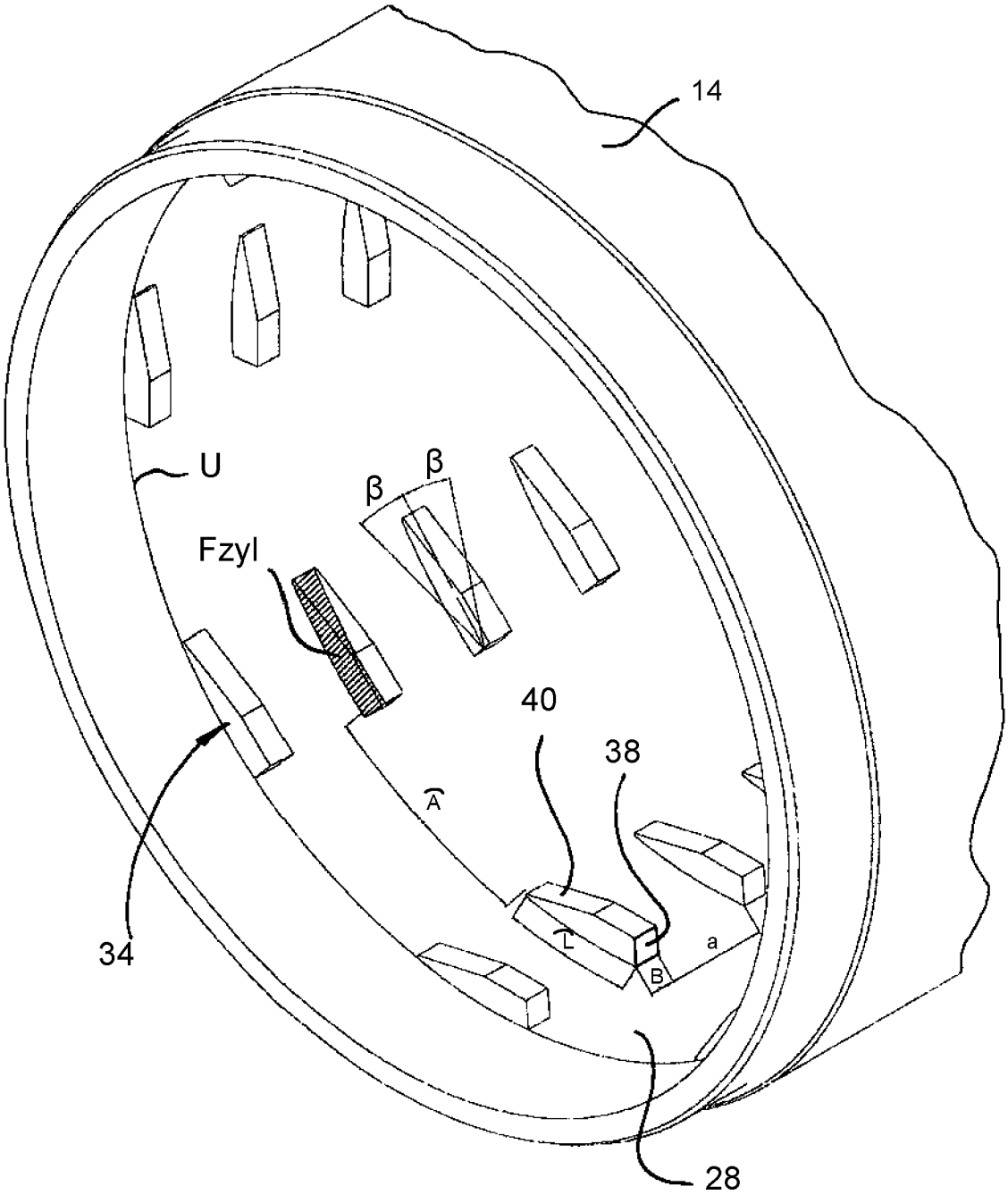
FIG. 2 shows a spatial representation of an end of a one-piece container tube, which comprises an inner side of a grinding container at which cams are arranged according to a first embodiment.

FIG. 2 shows in a spatial representation an end of one-piece container tube 14 made of ceramic material in a state dismantled from agitator mill 10. It can clearly be seen that a multiplicity of cams 34 are arranged on inner side 28 of the grinding container each successively in a row along a plurality of peripheral lines U spaced apart from one another in axial direction X (a peripheral line is shown for example in FIG. 2) of the inner side of the grinding container. The spacing between two axially adjacent cam rows is denoted by a, the spacing between two cams 34 following one another along a peripheral line in the peripheral direction, on the other hand, is denoted by A. in the example of the embodiment represented in FIG. 2, all cams 34 have the same spacing A from one another in the peripheral direction, axial spacing a between each two cam rows is the same for all the cam rows and cams 34 following one another in the axial direction are each aligned with one another. In examples of embodiment not shown, however, the cams of two axially adjacent cam rows can be arranged offset with respect to one another and/or spacing A in the peripheral direction can vary, also within a single cam row. In addition, axial spacing a does not have to be the same for all cam rows, but rather can be selected differently, in order for example to increase or reduce a cam density in specific regions of inner side 28 of the grinding container.

Figure 10:
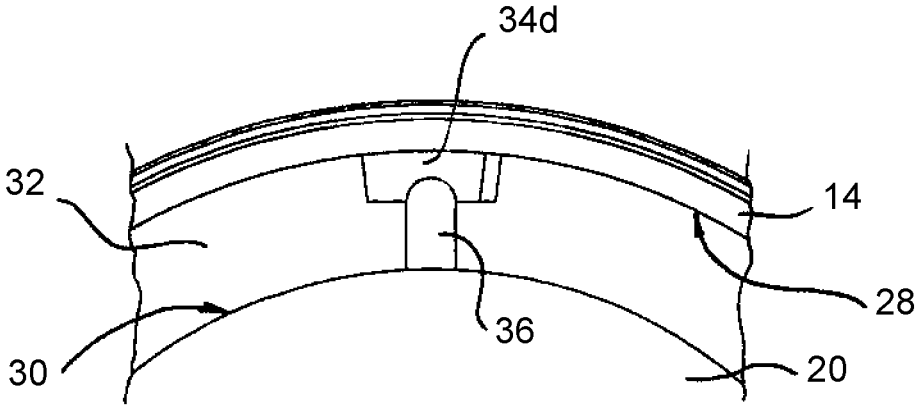
FIG. 10 shows a view similar to FIG. 9, but with cams at the inner side of the grinding container according to the fifth embodiment and agitator rods on the rotor in an overlapping arrangement.

Each cam 34 is characterised by specific parameters, whereof maximum height h measured normal to inner side 28 of the grinding container has already been mentioned. Maximum height h of cams 34 is selected in the embodiment shown in FIG. 2 such that an overlapping arrangement with agitator rods 36 results, i.e. $MS-H<h$ applies. With such an arrangement, referred to as overlapping, the free end portions of agitator rods 36 accordingly enter into the gaps present between the cam rows spaced apart from one another axially. An illustration of this state, albeit with a different cam shape, is represented in FIG. 10.

Each cam 34 lies with its base or connecting surface area $F_{Zyl}$ on inner side 28 of the grinding container. For the purpose of illustration, connecting surface area $F_{Zyl}$ of a cam 34 is represented shaded in FIG. 2. The maximum width of this connecting surface area $F_{Zyl}$ is denoted by B, the maximum length of connecting surface area $F_{Zyl}$ on the other hand by L. In FIG. 2, the width of connecting surface area $F_{Zyl}$ over the entire length L of connecting surface area $F_{Zyl}$ has the value of maximum width B, but in other embodiments this can be otherwise. For example, maximum width B can occur only at one point of the length extension of a cam 34, or only in a specific region. It goes without saying that, on account of the cylindrical curvature of inner side 28 of the grinding container, connecting surface area $F_{Zyl}$ of a cam 34 is also a cylindrically curved surface and that length L and spacing A can be given in radian measure.

Furthermore, each cam 34 has a frontal incident-flow surface area 38 which, in the case of cam 34 represented in FIG. 2, is steeper than a trailing-flow surface area 40 inclined flat in a ramp-like manner and arranged opposite to incident-flow surface area 38. An angle of inclination a of frontal incident-flow surface area 38 shown in FIG. 3 can be in a range from $-45°<\alpha\leq 85°$ relative to a plane lying normal to the inner side of the grinding container. An angle $\alpha=0°$ corresponds to an incident-flow surface area 38 which runs normal to inner side 28 of the grinding container. An angle $\alpha>0°$ corresponds to an inclination of frontal incident-flow surface area 38, as it is represented in FIG. 2 and at which a lower edge of incident-flow surface area 38 arranged at inner side 28 of the grinding container is first contacted by the inflowing medium. On the other hand, an angle $\alpha<0°$ means that a radially upper edge of frontal incident-flow surface area 38 leads the previously described lower edge, i.e. a frontal incident-flow surface area 38 thus inclined leads to the formation of an undercut cam 34 at the incident-flow side.

Figure 3:
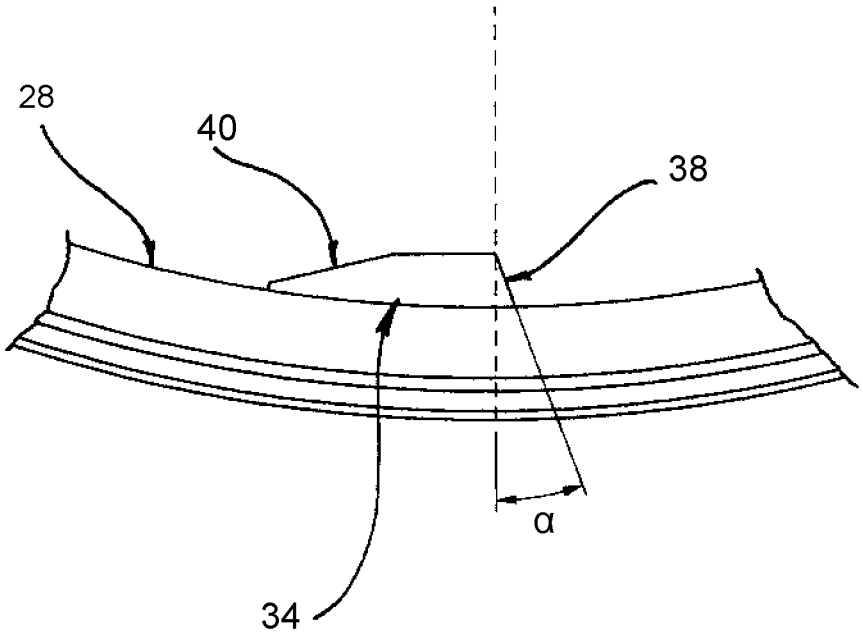
FIG. 3 shows a side view of one of the cams from FIG. 2.

If, as represented in FIGS. 2 and 3, frontal incident-flow surface area 38 is steeper than trailing-flow surface area 40, this leads during operation of agitator mill 10 to an increased deceleration of particles and auxiliary grinding bodies located in the vicinity of inner side 28 of the grinding container, which in particular has an effect such that the concentration of auxiliary grinding bodies in the vicinity of inner side 28 of the grinding container is avoided, because, as a result of the deceleration of the auxiliary grinding bodies, the latter are conveyed radially inwards again into grinding gap 32 and thus are mixed better with the material to be size-reduced. However, it may sometimes also be advantageous, depending on the size-reduction task to be accomplished, if frontal incident-flow surface area 38 is inclined flatter than trailing-flow surface area 40.

Irrespective of the other embodiment of a cam 34, however, it is the case for all cams 34 that the ratio of maximum height h of each cam 34 and inner diameter d of the grinding container is ≤0.05, i.e. h/d≤0.05. It is also the case for all cams 34 that the ratio of maximum height h of each cam 34 and the grinding gap width is MS≤0.35, i.e. h/MS≤0.35.

It is also advantageous if, for all cams 34, it is the case that the ratio of maximum height h of each cam 34 and maximum width B of connecting surface area $F_{Zyl}$ is greater than 0.2, i.e. h/B>0.2.

It is also advantageous if, for all cams 34, it is the case that the ratio of maximum height h of each cam 34 and maximum length L of connecting surface area $F_{Zyl}$ is less than 1, i.e. h/L<1.

It is particularly advantageous if, for all cams 34, it is the case that the ratio of maximum width B and of maximum length L of connecting surface area $F_{Zyl}$ is less than 1, i.e. B/L<1.

If a plurality of cams 34 are arranged successively along a peripheral line U, as represented in FIG. 2, spacing A between each two cams 34 following one another in the peripheral direction is advantageously at least as large as maximum length L of a cam 34 or its connecting surface area $F_{Zyl}$.

Finally, if a multiplicity of cams 34 are arranged in each case in a row along a plurality of peripheral lines spaced apart from one another in the axial direction, as is also shown in FIG. 2, an axial spacing a between each two axially adjacent cam rows advantageously amounts to at least 1.1 times maximum width B of a cam 34 or its connecting surface area $F_{Zyl}$.

As indicated in FIG. 2 by angle β, cams 34 do not necessarily have to extend over their length on a peripheral line, but can be arranged inclined at an angle β with respect to a peripheral line of inner side 28 of the grinding container, wherein this angle β preferably lies in a range of −22.5°≤β≤22.5°.

In all the embodiments of agitator mill 10 according to the present invention, one-piece container tube 14 is preferably made of silicon carbide or silicon carbide with free silicon, wherein cams 34 are then preferably made of the same material.

FIGS. 4 to 8 represent various embodiments of cams 34, which are fitted at inner side 28 of the grinding container.

Figure 4:
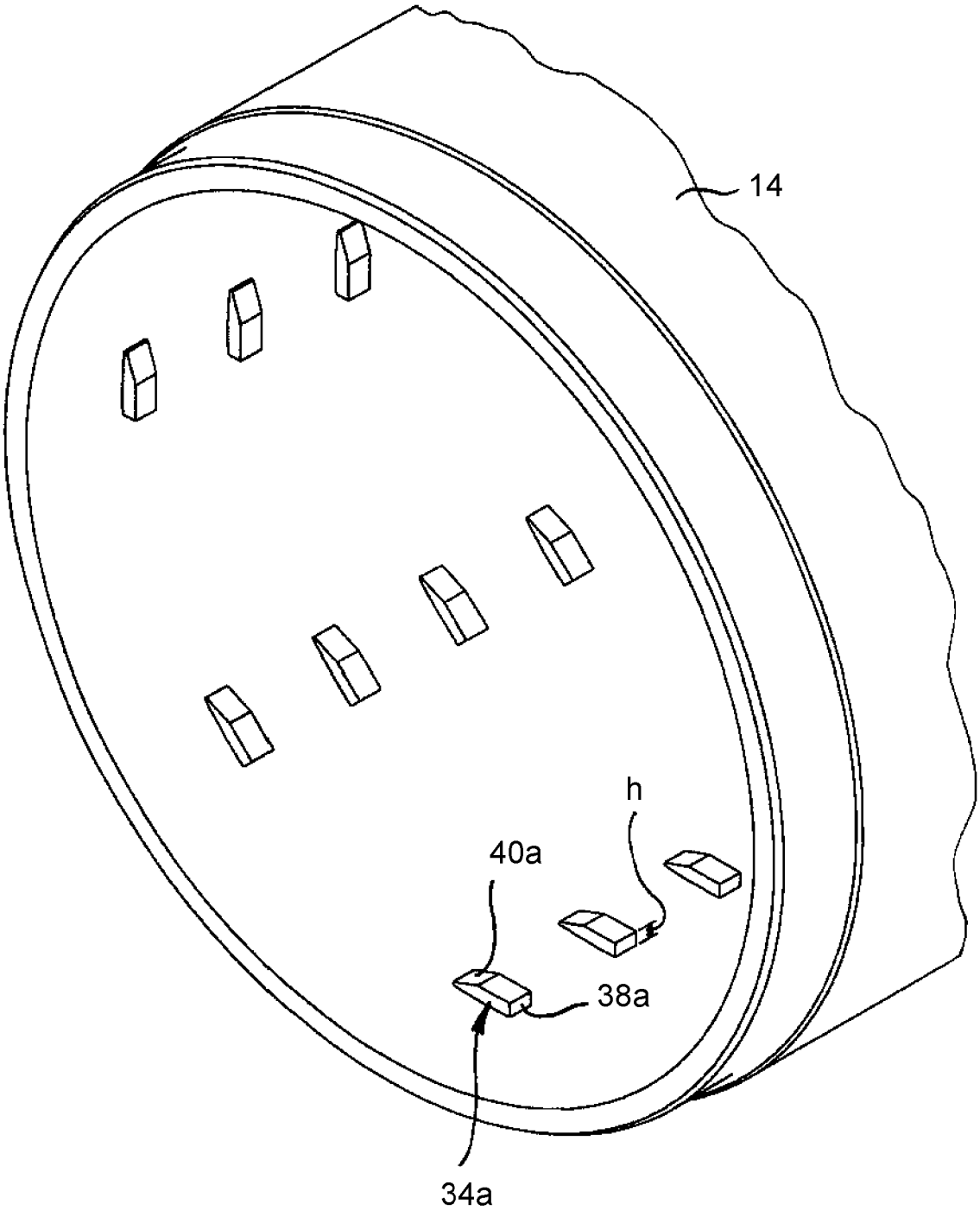
FIG. 4 shows a view similar to FIG. 2, but with cams at the inner side of the grinding container according to a second embodiment.
Figure 9:
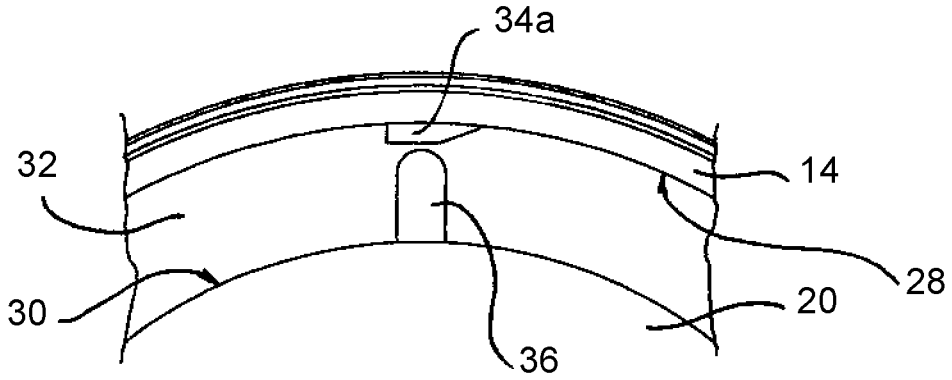
FIG. 9 shows a detail view of a section of the grinding gap with cams at the inner side of the grinding container according to the second embodiment and agitator rods on the rotor in a non-overlapping configuration.

FIG. 4 shows cam 34 a similar to cam 34 represented in FIG. 2, but in the case of cam 34 a the frontal incident-flow surface area 38 a (shown with trailing-flow surface area 40 a) stands exactly normal to inner side 28 of the grinding container and maximum height h is much smaller, so that the end portions of agitator rods 36 do not enter into the gaps present between the cam rows, i.e. MS H>h applies. This state is illustrated in FIG. 9.

Figure 5:
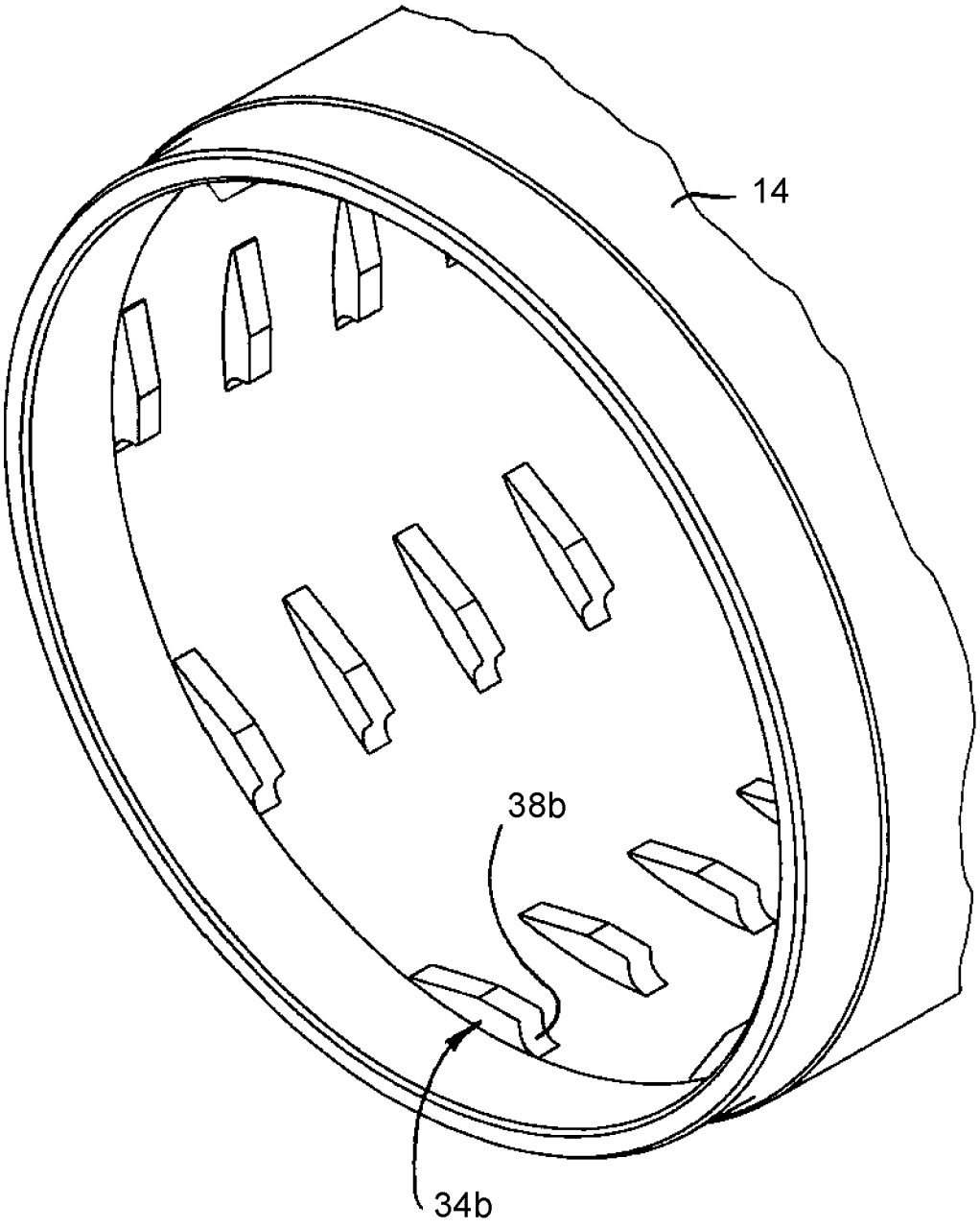
FIG. 5 shows a view similar to FIG. 4, but with cams at the inner side of the grinding container according to a third embodiment.

FIG. 5 shows cam 34*b* with a shape similar to cam 34 from FIG. 2, but in the case of cam 34*b* frontal incident-flow surface area 38*b* has a blade-like curved shape.

Figure 6:
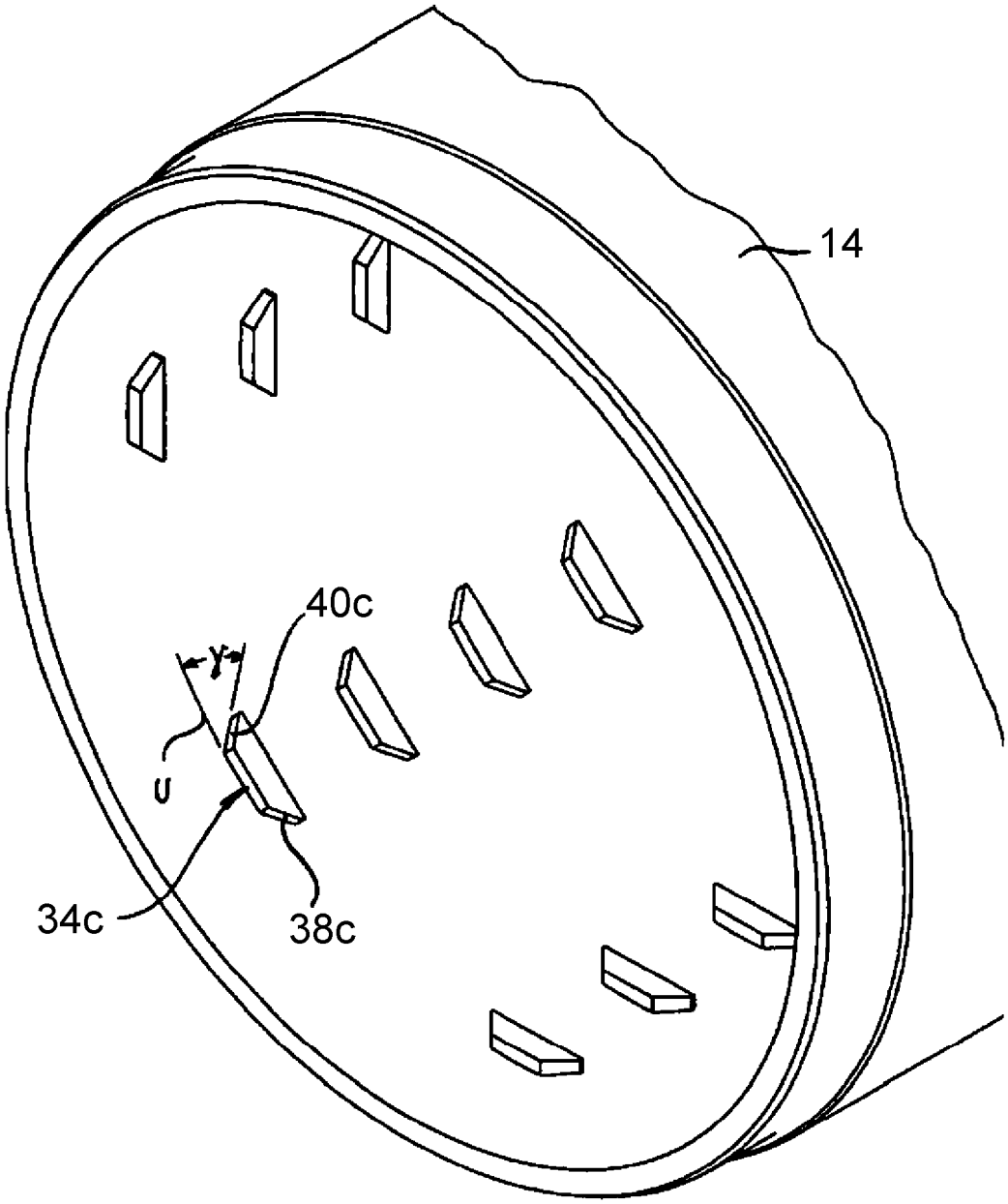
FIG. 6 shows a view similar to FIG. 4, but with cams at the inner side of the grinding container according to a fourth embodiment.

FIG. 6 shows cam 34*c*, height h whereof is constant over the entire length L (neglecting the height differences resulting due to curved connecting surface area $F_{Zyl}$). Both frontal incident-flow surface area 38*c* and trailing-flow surface area 40*c* are arranged at an angle of α=0° to inner side 28 of the grinding container, but are not at right angles to the respective peripheral line, but rather are arranged inclined at an angle γ to the latter, wherein incident-flow surface area 38*c* is inclined at the same angle γ, but in the opposite direction to trailing-flow surface area 40*c*. On account of the overall smaller height h, the cam arrangement shown in FIG. 6 does not overlap agitator rods 36.

Figure 7:
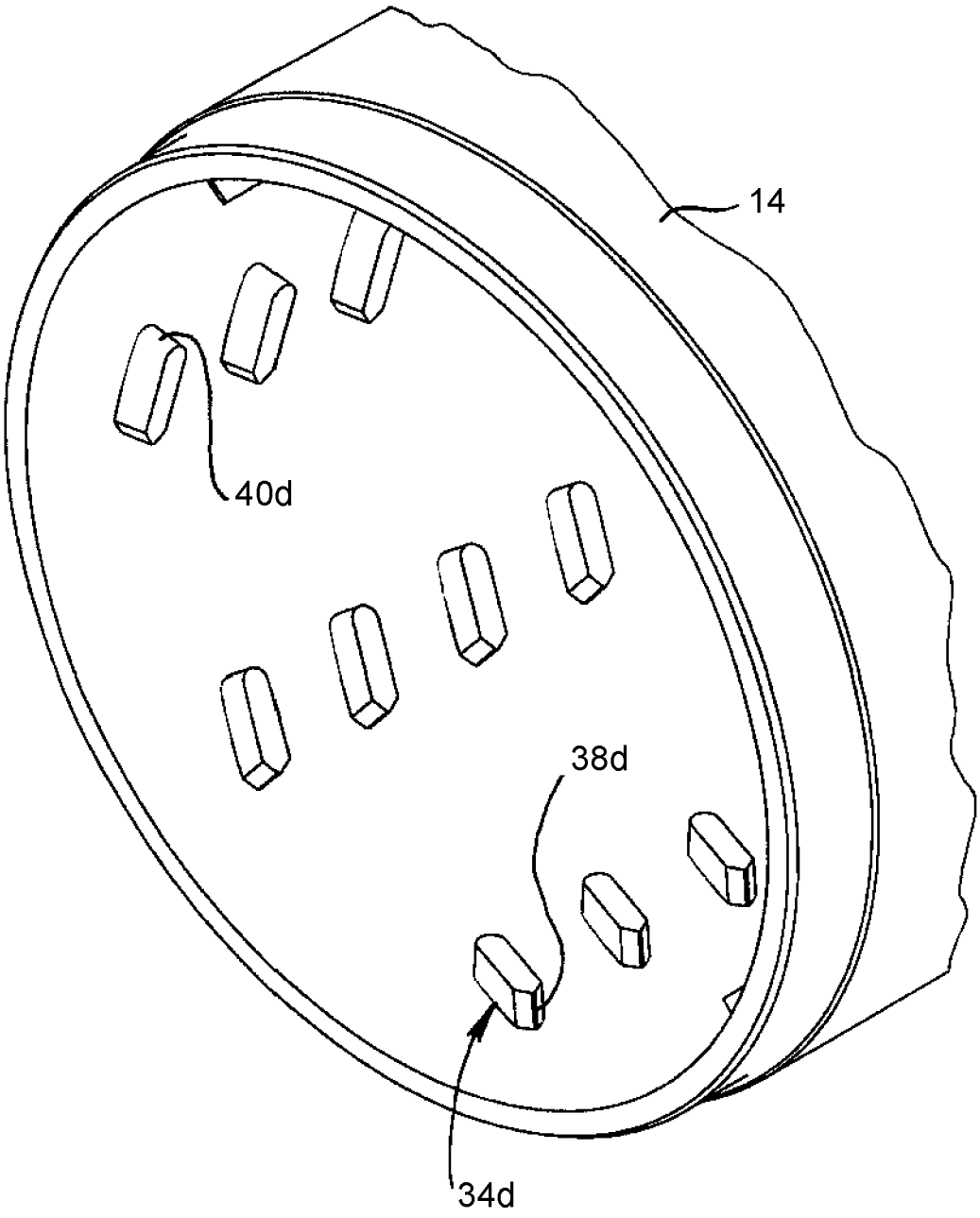
FIG. 7 shows a view similar to FIG. 4, but with cams at the inner side of the grinding container according to a fifth embodiment.

FIG. 7 shows cam 34*d* with a slightly inclined frontal incident-flow surface area 38*d* similar to FIG. 2, but in contrast with FIG. 2 it runs pointed in a wedge-like manner. Rear trailing-flow surface area 40*d*, on the other hand, is constituted rounded and has an inclination which corresponds, in terms of amount, roughly to that of front incident-flow surface area 38*d*. On account of greater height h, it is here a cam arrangement overlapping with agitator rods 36. As represented, cams 34*d* in this embodiment are all arranged inclined at the same angle β with respect to a peripheral line U of inner side 28 of the grinding container.

Figure 8:
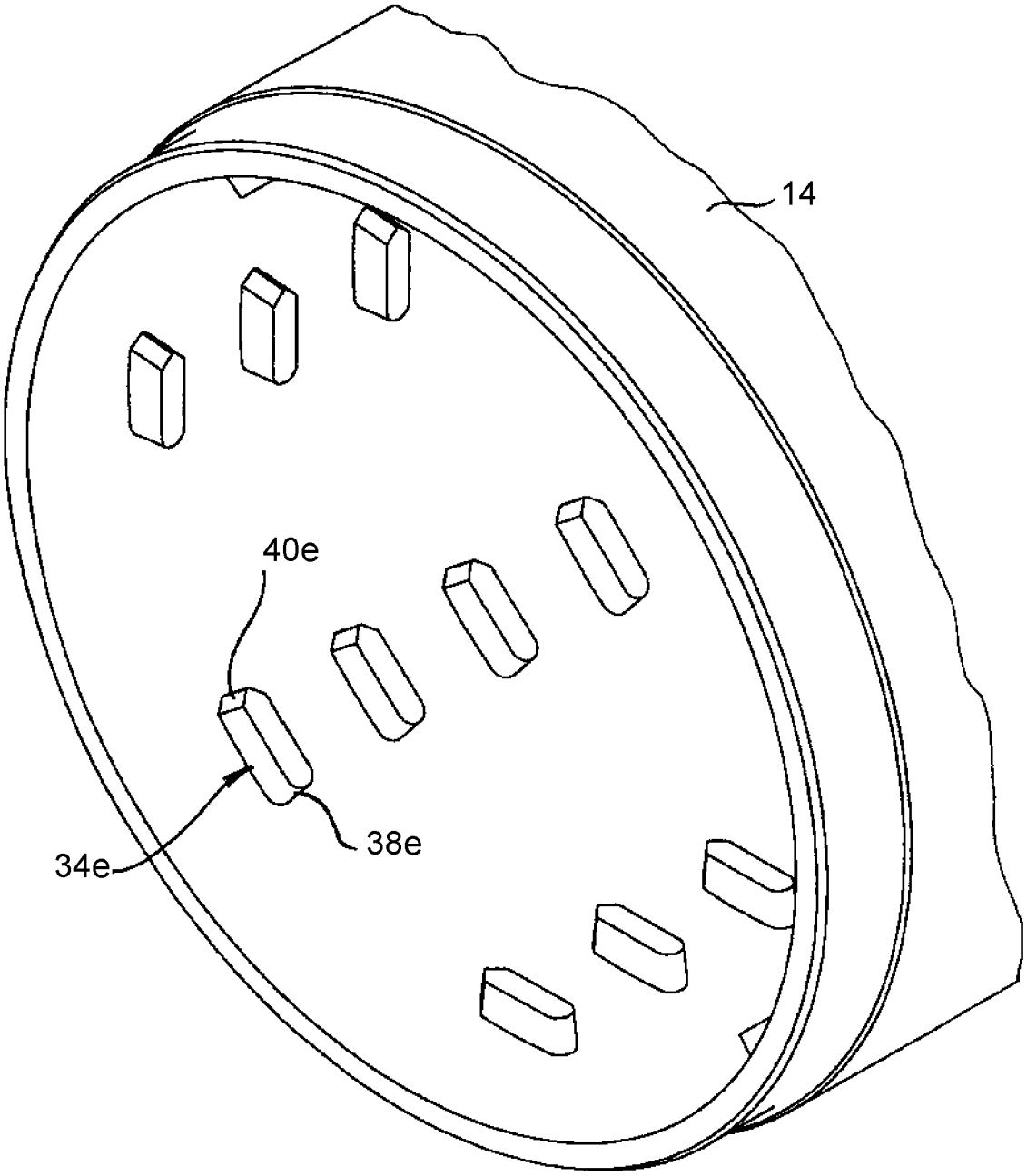
FIG. 8 shows a view similar to FIG. 4, but with cams at the inner side of the grinding container according to a sixth embodiment.

Finally, FIG. 8 shows cams 34*e* with a shape corresponding to the cams from FIG. 7, but in contrast with FIG. 7 are arranged inverted, i.e. the rounded end-face of the cam here is incident-flow surface area 38*e* and the wedge-like pointed end-face of the cam is trailing-flow surface area 40*e*. As a further difference from FIG. 7, all cams 34*e* are each arranged along a peripheral line and not obliquely with respect to the latter.

FIG. 9 shows, with the aid of cam 34*a* from FIG. 4 and an agitator rod 36, a non-overlapping arrangement of cams and agitator rods, i.e. agitator rods 36, on account of the small height h of the cams, do not enter into the gaps present between the cam rows.

FIG. 10, on the other hand, shows, with the aid of cam 34*d* from FIG. 7 and an agitator rod 36, an overlapping arrangement of cams and agitator rods, i.e. height h of the cams is so great that, in the lateral projection view of FIG. 10, the free end of agitator rod 36 overlaps with cam 34*d*, which means nothing other than that, during the operation of the agitator mill, agitator rods 36 enter into the gaps present between the cam rows axially spaced apart from one another.

What is claimed is:

1. An agitator ball mill, comprising:

a grinding container that extends along an axis and has an inner diameter, a rotor which is arranged inside the grinding container and can be driven rotatably about the axis and has a surface facing the inner side of the grinding container, wherein a grinding gap with a grinding gap width is formed between the surface of the rotor and the inner side of the grinding container, a plurality of cams, which are fitted to the inner side of the grinding container and extend radially inwards from the inner side of the grinding container with a height normal to the inner side of the grinding container, wherein the inner side of the grinding container is formed by a one-piece container tube made of ceramic material, the ratio of the height of each cam and the inner diameter of the grinding container is ≤0.05, and the ratio of the height of each cam and the grinding gap width is ≤0.35.

2. The agitator ball mill according to claim 1, wherein the container tube and the cams comprise silicon carbide or silicon carbide with free silicon.

3. The agitator ball mill according to claim 1, wherein each cam has a connecting surface area to the inner side of the grinding container with a maximum width and the ratio of the height of each cam and the maximum width is greater than 0.2.

4. The agitator ball mill according to claim 1, wherein each cam has a connecting surface area to the inner side of the grinding container with a maximum length and the ratio of the height of each cam and the maximum length is less than 1.

5. The agitator ball mill according to claim 1, wherein each cam has a connecting surface area to the inner side of the grinding container with a maximum length and a maximum width, wherein the ratio of the maximum width and the maximum length is less than 1.

6. The agitator ball mill according to claim 1, wherein each cam has a connecting surface area to the inner side of the grinding container and a frontal incident-flow surface area, wherein a ratio of a projection of the frontal incident-flow surface area onto a plane lying normal to the inner side of the grinding container and the connecting surface area is less than 1.

7. The agitator ball mill according to claim 6, wherein an angle of inclination of the frontal incident-flow surface area relative to the plane lying normal to the inner side of the grinding container lies in a range of $-45° < \alpha \leq 85°$.

8. The agitator ball mill according to claim 4, wherein the plurality of cams are arranged successively in a row along a peripheral line in the peripheral direction of the inner side of the grinding container and a spacing between successive cams in the peripheral direction is the maximum length of a cam.

9. The agitator ball mill according to claim 3, wherein at least some of the plurality of cams are each arranged successively in a row along a plurality of peripheral lines spaced apart from one another in the axial direction and that an axial spacing between each two axially adjacent cam rows is greater than or equal to 1.1 times the maximum width of a cam.

10. The agitator ball mill according to claim 8, wherein some or all the cams, viewed in plan view, are arranged at an angle to the respective peripheral line, wherein the angle lies in a range from $-22.5° \leq \beta \leq 22.5°$.

11. The agitator ball mill according to claim 2, wherein each cam has a connecting surface area to the inner side of the grinding container with a maximum width and the ratio of the height of each cam and the maximum width is greater than 0.2.

12. The agitator ball mill according to claim 9, wherein some or all the cams, viewed in plan view, are arranged at an angle to the respective peripheral line, wherein the angle lies in a range from $-22.5° \leq \beta \leq 22.5°$.

13. An agitator ball mill, comprising:

a grinding container that extends along an axis and has an inner diameter;

a rotor arranged inside the grinding container that rotates about the axis and has a surface facing an inner side of the grinding container;

a grinding gap with a grinding gap width between the surface of the rotor and the inner side of the grinding container;

a plurality of cams on the inner side of the grinding container that extend radially inwards and have a height normal to the inner side of the grinding container;

the inner side of the grinding container is formed by a one-piece container tube made of ceramic material;

a ratio of the height of each cam and the inner diameter of the grinding container is $\leq 0.05$;

the ratio of the height of each cam and the grinding gap width is $\leq 0.35$.

14. The agitator ball mill according to claim 13, wherein the container tube and the cams comprise silicon carbide.

15. The agitator ball mill according to claim 14, wherein each cam has a connecting surface area to the inner side of the grinding container with a maximum width and a ratio of the height of each cam and the maximum width is greater than 0.2.

16. The agitator ball mill according to claim 15, wherein the ratio is less than 1.

17. The agitator ball mill according to claim 13, wherein each cam has a connecting surface area to the inner side of the grinding container with a maximum length and a maximum width, wherein the ratio of the maximum width and the maximum length is less than 1.

18. The agitator ball mill according to claim 13, wherein at least some of the plurality of cams are arranged successively in a row along a peripheral line in the peripheral direction of the inner side of the grinding container.

19. The agitator ball mill according to claim 18, further comprising a casing radially spaced from the one-piece container tube.

* * * * *